US006319385B1

(12) United States Patent
Müll

(10) Patent No.: US 6,319,385 B1
(45) Date of Patent: Nov. 20, 2001

(54) PROCESS FOR ELECTROCHEMICALLY APPLYING A SURFACE COATING

(75) Inventor: Karl Müll, Volketswil-Kindhausen (CH)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/401,020

(22) Filed: Sep. 21, 1999

Related U.S. Application Data

(62) Division of application No. 08/629,185, filed on Apr. 8, 1996, now Pat. No. 5,958,207, which is a continuation of application No. PCT/EP94/03314, filed on Oct. 1, 1994.

(30) Foreign Application Priority Data

Oct. 7, 1993 (DE) ..... 43 34 122

(51) Int. Cl.[7] ..... C25D 5/18

(52) U.S. Cl. ..... 205/104; 205/102; 205/111; 205/112; 205/179

(58) Field of Search ..... 205/104, 105, 205/108, 102, 111, 112, 170, 179

(56) References Cited

U.S. PATENT DOCUMENTS

| | | | |
|---|---|---|---|
| 3,627,650 | 12/1971 | Seuffert | 205/102 |
| 3,963,587 | 6/1976 | Kreckel | 205/73 |
| 4,200,674 | 4/1980 | Inoue | 427/290 |
| 4,738,756 | 4/1988 | Mseitif | 205/50 |
| 4,804,446 | 2/1989 | Lashmore et al. | 205/104 |
| 4,857,154 | 8/1989 | Shindo et al. | 205/155 |
| 4,879,018 | 11/1989 | Fenoglio et al. | 205/108 |
| 5,185,073 | 2/1993 | Bindra et al. | 205/104 |
| 5,415,761 | 5/1995 | Müll | 205/104 |

FOREIGN PATENT DOCUMENTS

| | | |
|---|---|---|
| 134 785 | 1/1978 | (DE) . |
| 33 07 748 C2 | 9/1983 | (DE) . |
| 42 11 881 A1 | 10/1993 | (DE) . |

OTHER PUBLICATIONS

"Electroplating" (Löwenheim), McGraw Hill Book Company, New York, 197 month of publication not available, p. 129.

"Plating with Puked and Periodic–Reverse Current—Metal Finishing" (Tai–Ping Sun et al.), May 1979, pp. 33–38.

*Primary Examiner*—Kathryn Gorgos
*Assistant Examiner*—William T. Leader
(74) *Attorney, Agent, or Firm*—Herbert L. Lerner; Laurence A. Greenberg; Werner H. Stemer

(57) ABSTRACT

A structured surface coating is electrochemically deposited on an (electrically conductive) surface of a component. The component to be coated forms the cathode in a galvanic bath. The process current is raised in discrete steps in a nucleation phase during which island formations are deposited on the surface, with brief pauses between each increase of between 0.1 and 30 sec. The process current is then maintained at a constant level, during which the islands grow. The process sequence may be repeated several times.

18 Claims, 3 Drawing Sheets

PROCESS FOR ELECTROCHEMICALLY APPLYING A SURFACE COATING

CROSS-REFERENCE TO RELATED APPLICATION

This is a divisional of U.S. application Ser. No. 08/629,185, filed Apr. 8, 1996, now U.S. Pat. No. 5,958,207, which was a continuation of international application No. PCT/EP94/03314, filed Oct. 1, 1994.

BACKGROUND OF THE INVENTION

Field of the Invention

The invention relates to a process for electrochemically (galvanically) applying a surface coating. In particular, the invention relates to a process for depositing a surface coating on a component as described in my earlier U.S. Pat. No. 5,415,761.

Surface structures described therein are obtained by chemical etching after coating or by mechanical machining such as grinding or sand-blasting. A hard-chromium layer is then applied to the thus created surface structure. The various processing steps required in the production of such components are elaborate and they require complex process technology. The final cost is essentially determined by the mechanical or chemical processing steps necessary for generating the structure.

In structuring metal coating layers, use is also made of elaborate and very difficult-to-control dispersion-deposition processes in which a specific surface structure is obtained through organic or inorganic foreign substances which are included, for example, in a chromium layer and/or which block the growth of the chromium layer during the deposition process. The result is a rough surface. The foreign substances are present in the form of dispergate in the electrolyte.

U.S. Pat. Nos. 4,468,293 and 4,515,671 to Polan et al. relate to a process for electrochemical coating in which a pulse-like current is used for nucleation. A first portion of the pulse has a relatively high current for less than 0.1 sec. and the second portion of the pulse has a much lower current. If a suitable current density is used, the resulting nuclei form a dendritic structure. It is thus possible in one working operation to generate rough dendritically structure surfaces. The current density is understood to be the mean current density at the cathode surface.

SUMMARY OF THE INVENTION

It is accordingly an object of the invention to provide a process for applying a surface coating, which overcomes the above-mentioned disadvantages of the heretofore-known processes of this general type. More specifically, the object is to propose an improved process for the electrochemical application of structured metal layers—such that no further mechanical or chemical aftertreatment is necessary and which allows the generation of diverse structured metal layers. It is a further object to provide an apparatus for implementing the process.

With the foregoing and other objects in view there is provided, in accordance with the invention, an improved process for electrochemically depositing a surface coating, wherein a component is subjected to a galvanic bath and the surface layer is deposited on the component with a structured outer surface topography, by forming a plurality of island formations of deposition material on a surface of the component by providing an electrical pulse with a source of electrical energy, and causing a growth of the deposition material on the plurality of island formations for forming the structured outer surface topography with a follow-up pulse of the source of electrical energy. The improvement comprises the step of increasing a strength of the electrical pulse (e.g. current or voltage) during the step of forming the plurality of island formations in a plurality of steps.

The structured layer is applied directly by galvanic means to the object that is to be coated. For this purpose, the object must have an electrically conductive surface which, usually, has been ground in order to provide a smooth substrate base for the structured layer. Prior to the coating process, the object is cleaned and degreased according to conventional electro-deposition practice. The object is immersed as the cathode into a galvanic bath in which there is also an anode. The distance between the anode and the cathode is usually in the range between 1 and 40 cm.

The following are preferably used as electrolyte: chromium electrolytes, particularly sulfuric chromium electrolytes, nitrosulfuric chromium electrolytes or alloying electrolytes.

A process voltage may be applied between anode and cathode and the flowing current causes a coating of material on the object to be coated, which is used as the cathode. The invention proposes that positive current steps be applied in order to form islands. The process of structure generation consists of a nucleation phase (seed creation) and an island growth phase. First of all, in the nucleation phase, process voltage and process current are increased in a plurality of steps from a starting value to a structure current density with in each case a predeterminable change in the current density of 1 to 6 $mA/cm^2$ per step. The starting value is 0 $mA/cm^2$, but it may also be higher if the nucleation phase directly follows a preceding galvanic process phase and the current is not lowered in between to zero. The time between two current-density increases is approximately 0.1 to 30 seconds. Most frequently, intervals between steps of approximately 7 seconds are employed. New nuclei are formed with each current step. In contrast to pulse-current coating, the process current in this case does not fall back to zero after each positive step, but it is further increased with each current step. This makes it possible, in particular, for more roundly and more uniformly shaped nuclei or bodies to be deposited on the object than is possible with the known pulse-current processes. The current steps are applied to the bath in such a number until a structured layer consisting of deposits of individual or adjacent, approximately spherical or dendritic bodies (islands) is obtained on the surface of the object.

Preferably, a structured-layer thickness of 4 $\mu$m to 10 $\mu$m is desired with the nucleation phase. Usually, this necessitates between 10 and 240 current steps, particularly good results being obtained with 50 to 60 steps.

The current density obtained after completion of the last current step is the structure current density. Reaching the structure current density largely signals the completion of the nucleation phase, the actual formation of the structure. The configuration of the resulting structure is dependent on many parameters, above all on the selected structure current density, the number, magnitude and time interval of the current steps, the immersion bath temperature, and the electrolyte used. The current density per step as well as the time between two current-density increases can be changed during the nucleation phase. Depending on the nature of the current function, it is possible to produce different surface structures which are mainly characterized by different peak-to-valley heights. The ideal process parameters can be established simply by empirical means. In general terms, it may be stated that a higher bath temperature and a higher acid content of the electrolyte entails employing a greater structure current density.

Usually, the structure current density is two to three times the current density used in the case of normal direct-current coating. Direct-current coating employs current densities in the range from 15 to 60 $mAcm^2$, the value of the current density being dependent on the electrolyte and on the bath temperature. In the case of structure coating, current densities in the range from 30 to 180 $mA/cm^2$ are possible.

Next comes the nucleus-growth phase, also referred to as the island growth formation. A process current with a current density in the range from 80% to 120% of the structure current density is thereby applied during a predetermined ramp period. An approximately uniform current flows during the ramp period; this leads to the growth of the structure produced on the object. Depending on the duration of the ramp period, the structure layer may be more or less heavily pronounced. Growth takes place faster at the highest points of the structure layer than at the low points between the island nuclei deposited in the nucleation phase. This results, initially, in a further increase in the roughness during the nucleus-growth phase. The ramp period is usually in a range from 1 to 600 seconds, preferably about 30 seconds.

Subsequently to the ramp period, the process current is lowered to an end value, frequently to zero. The process current may thereby be lowered to the end value abruptly; however, a ramp-like lowering is also possible. Here too, good results have been obtained with discrete steps in changing the process current. These current steps (current gradations) are preferably in a range from −1 to −8 $mA/cm^2$ per step and the time between two current steps is preferably in the range from 0.1 to 1 second.

So far we have described three process steps: the stepwise rise of the process current during the nucleation phase up to the structure current density; the holding of the process current in the vicinity of the structure current density during the ramp period (nucleus-growth phase); and the subsequent decrease in the process current to an end value. These process steps represent a structure-generation cycle. They may be cyclically repeated. This is of particular advantage in cases in which heavier structuring of the surface is desired. In this connection, the end value of the preceding cycle corresponds to the starting value of the following cycle. The number of repetitions is dependent on the desired surface structure and layer thickness. Superior results have been obtained with repetitions between two and twenty times. The end values of the individual cycles may differ in magnitude.

In accordance with a further feature of the invention, the object to be coated is initially immersed in the bath for some time, preferably one minute, prior to the start of the process. The waiting period is primarily used for equalizing the temperatures, such that the base substrate material may assume the approximate temperature of the electrolyte.

Good results are obtained if, prior to the application of the structured layer, a direct-current base layer is applied under the conditions customary for normal chromium plating. This is achieved in that, at the commencement of coating, a basic pulse (voltage or current pulse) is applied, a current density of 15 to 60 $mA/cm^2$ being employed. This corresponds to the current values customary in the case of normal chromium-plating. The basic pulse has a duration of approximately 600 seconds. In order to eliminate changes in concentration through the preceding direct-current treatment in the phase boundary layer prior to generation of the structure, it is advantageous if, after the basic pulse and prior to structure formation, a current-free interval of approximately 60 seconds is added.

The process described herein is useful in many industrial technical applications, i.e. where there is a need for components with special surface characteristics. It has been known heretofore to apply surface coatings to components by means of galvanic processes. Frequently, there are defined requirements with regard to the surface structure of the coated workpiece. For example, cylinder bearing surfaces are required to have defined lubricant-storage locations for holding lubricants, and medical or optical equipment is required to have surfaces with a low reflectivity. Defined reflectivity is also required for functional and decorative applications in the furniture and sanitary-fittings industries. In the graphics industry, dampening distributor rollers with a special, "rough" surface are required for printing presses. In the field of forming technology, structure-chromium-plated tools may be used in order to provide the workpiece with a structured surface. For example, a sheet metal surface may be structured by rolling with structure-chromium-plated rollers.

The device for implementing the process comprises a galvanic bath. The bath contains an electrolytic bath solution with a certain metal concentration. The following are preferably used as electrolyte: chromium electrolytes, particularly sulfuric chromium electrolytes, nitrosulfuric chromium electrolytes or alloying electrolytes. A preferred electrolyte has a concentration of 180 to 300 grams of chromic acid $CrO_3$ per liter. There may be added sulfuric acid $H_2SO_4$, hydrofluoric acid $H_2F_2$, silicofluoric acid $H_2SiF_6$ and mixtures thereof, A preferred electrolyte contains 1 to 3.5 grams of sulfuric acid $H_2SO_4$, per liter. The galvanic bath is usually heated to an electrolyte temperature of 30 to 55° C.

An anode and a cathode are immersed into the electrolytic bath solution, the object to be coated forming the cathode or at least part of the cathode. If a chromium electrolyte is used, platinized platinum or $PbSn_7$ is preferably used as the anode material. Anode and cathode are connected to an apparatus for supplying a process current. The process current can be increased from the starting value to the structure current density in a plurality of steps with in each case a predeterminable change in the current density of 1 to 6 $mA/cm^2$ per step. The time intervals between two current increases can be set between 0.1 and 30 seconds. After the structure current density has been reached, a process current with a current density in the range of 80% to 120% of the structure current density can be applied for a predeterminable ramp working period. In order to obtain uniform coating, the device may be furnished with a rotary drive for continuous rotation of the object. The distance between the anode and the object to be coated is in the range of 1 to 40 cm, preferably 25 cm.

Other features which are considered as characteristic for the invention are set forth in the appended claims.

Although the invention is illustrated and described herein as embodied in a process for the galvanic application of a surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
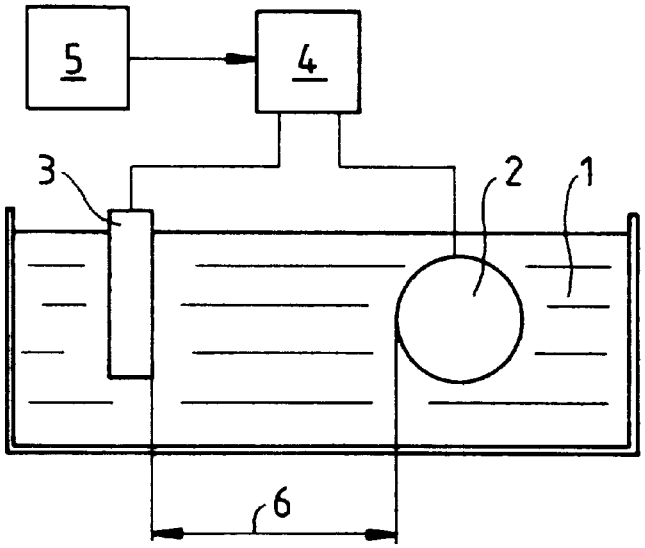
FIG. 1 is a schematic view of a device for the galvanic application of structured layers.

Referring now to the figures of the drawing in detail and first, particularly, to FIG. 1 thereof, there is seen a galvanic bath formed by a tank filled with electrolytic liquid 1. An object to be coated (the workpiece 2) and an anode 3 are immersed in the galvanic bath. The workpiece 2 forms the cathode. The anode and the cathode are connected to a controlled electric energy source 4. The energy source 4 may be a current source or a voltage source. Since, as far as the electrical influences are concerned, the current or the current density at the cathode is decisive with regard to coating, the process can be controlled more precisely with a current source. Conversely, the use of a voltage source has the advantage of a less complex electrical circuitry. As long as other parameters, such as the bath temperature and the concentration of the electrolyte, do not undergo major changes, it is also possible for the process to be efficiently controlled with a voltage source.

The electric energy source 4 is controlled by a programmable control unit 5. The control unit 5 makes it possible to specify any desired variations of the voltage or current with respect to time. The voltage or the current are then automatically applied at the electrodes via the energy source 4. Any preselected processing sequence for any particular substrate and surface structure may be stored in the control unit 5.

Figure 2:
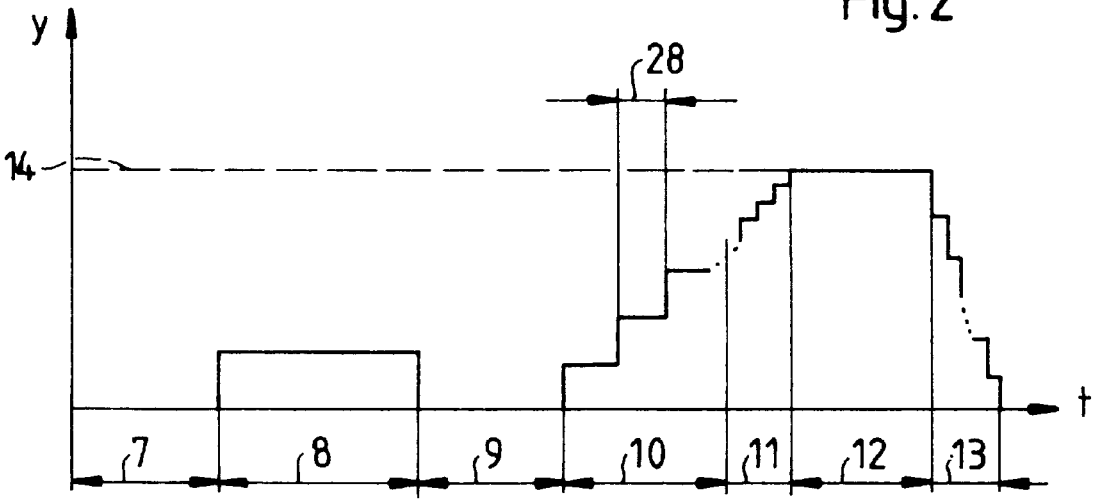
FIG. 2 is a graph showing the current density over time during the coating process.

FIG. 2 shows the graphic representation of the process current density with respect to time during the production of a structured layer. The horizontal axis in FIG. 2 is the time axis, the current density being shown on the vertical axis y. FIG. 2 shows an example of a possible process which is to be described in greater detail in the following.

There is used as the galvanic bath a sulfuric chromium electrolyte with 200 grams of chromic acid $CrO_3$ and 2 grams of sulfuric acid $H_2SO_4$. The workpiece 2 that is to be coated is a rotationally symmetrical component, a dampening distributor roller for the printing industry. In order to create a suitable starting surface for the structure chromium-plating, the cylinder, consisting of St52 (a normed high-grade steel), is first of all finely ground, with a peak-to-valley height of Rz<3 $\mu$m. Subsequently, a 30 $\mu$m nickel layer and, thereon, a 10 $\mu$m low-crack chromium layer are applied according to conditions customary in the field of electro-deposition. For the purpose of structure chromium plating, the pre-worked workpiece is then rotated in the galvanic bath in order to obtain as uniform a coating as possible. The workpiece forms the cathode; platinized titanium or $PbSn_7$ is used as the anode. The electrode distance between anode and cathode is set to 25 cm.

During a first process phase 7, the process current remains at zero. This phase serves to acclimatize the workpiece to the galvanic bath, the workpiece assuming the temperature of the electrolyte. After approximately one minute, a direct current between anode and cathode is switched on. The current remains on during phase 8, which lasts approximately 600 seconds, a chromium direct-current base layer being applied to the workpiece. The current density used is also usual for normal chromium plating, in this case 20 mNcm$^2$. After the direct-current base layer has been applied, there follows a second phase 9, once more without current.

Thereafter, the actual production of the structure commences. During phases 10 and 11, the current density is increased in steps to the structure current density 14. The technical characteristics of the steps (magnitude of the current steps and time interval between two current steps) are varied during the increase. In the first phase 10, the current is increased in 16 steps to 40 mA/cm$^2$. This corresponds to a change in the current density of 2.5 mA/cm$^2$ per step. The time 28 between two current steps is 5 seconds. Thereafter, during phase 11, the current density is increased in 62 further steps to the structure current density of 100 mAcm$^2$; the time between two current steps is 6 seconds (the variation in current density shown in the graph in FIG. 2 is not to scale; the same applies to the graphs shown in FIG. 5 and 6).

After the structure current density has been reached, the current density is held during the ramp working period 12. The direct current thU5 flowing leads to the growth of the structured layer produced in phases 10 and 11. The duration of the ramp working period is 60 seconds. Thereafter, the current density is once again lowered step by step, in 22 steps, to the end value of 0 mA/cm$^2$ the time between two current steps being 4 seconds.

For application-related reasons, in the case of the dampening distributor roller, a 4 to 8 $\mu$m thick micro-cracked chromium layer is subsequently applied to the chromium structured layer produced by the process according to the invention. The application of the micro-cracked chromium layer is carried out under the direct-current conditions customary for electro-deposition and is not described in any greater detail here.

Figure 3:
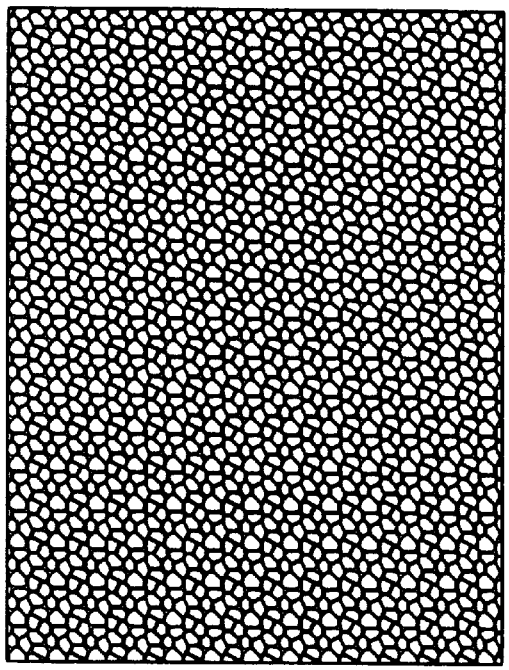
FIGS. 3 and 4 are micro-photographs of the structured layer produced by the process.
Figure 4:
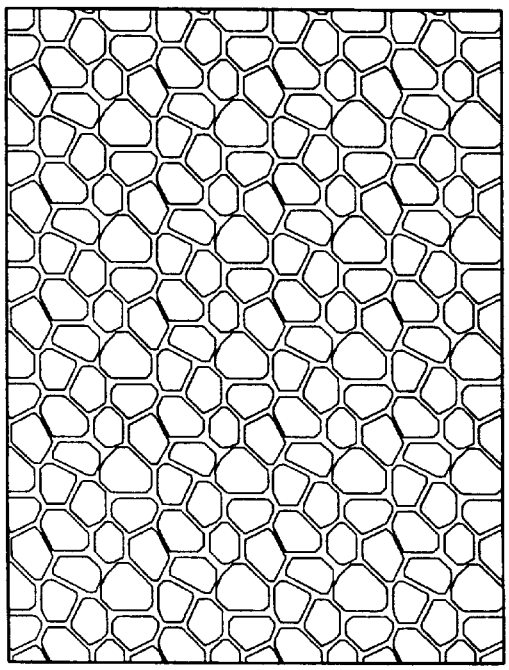

FIG. 3 and 4 show microscopic photographs of the chromium structured layer produced by the process described with reference to FIG. 2. The structured layer consists predominantly of approximately spherical, individual and partially adjacent island bodies. The structured layer shown has a surface roughness of Rz=8 $\mu$m with a percentage of contact area of 25%. The "percentage of contact area" is also defined as "percentage of material" according to DIN 4762 (German Industrial Norm 4762).

Figure 5:
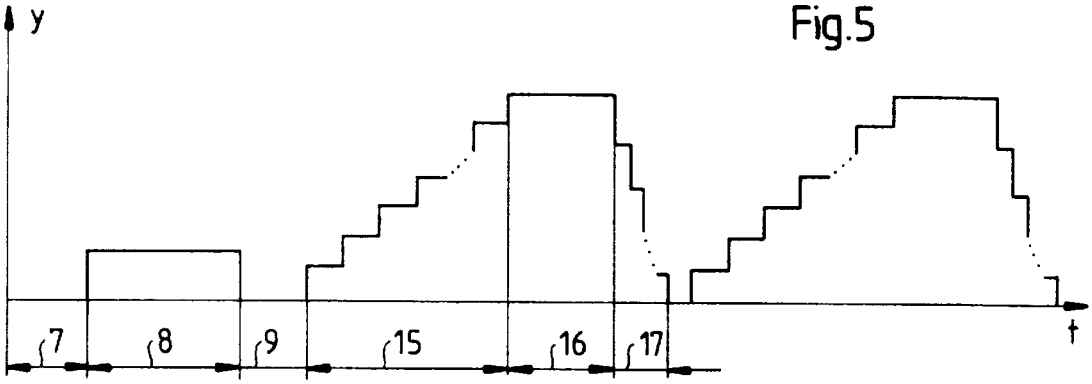
FIG. 5 is a graph of the current density over time for a further structured-coating process.

FIG. 5 shows the variation in current density with respect to time for a further structured-coating process. The process phases 7, 8 and 9 have already been discussed with reference to FIG. 2. In the following phase 15, the current density is increased in 110 equal steps to the structure current density of 100 mA/cm$^2$. The time between two current steps is 10 seconds. After the ramp working period 16 of 60 seconds, the current density is lowered, this time in 22 equal steps, to the end value of 0 mA/cm$^2$. The time between two current steps is 4 seconds. Thereafter, following a short current-free period, the process cycle, consisting of phases 15, 16 and 17, is repeated.

Figure 6:
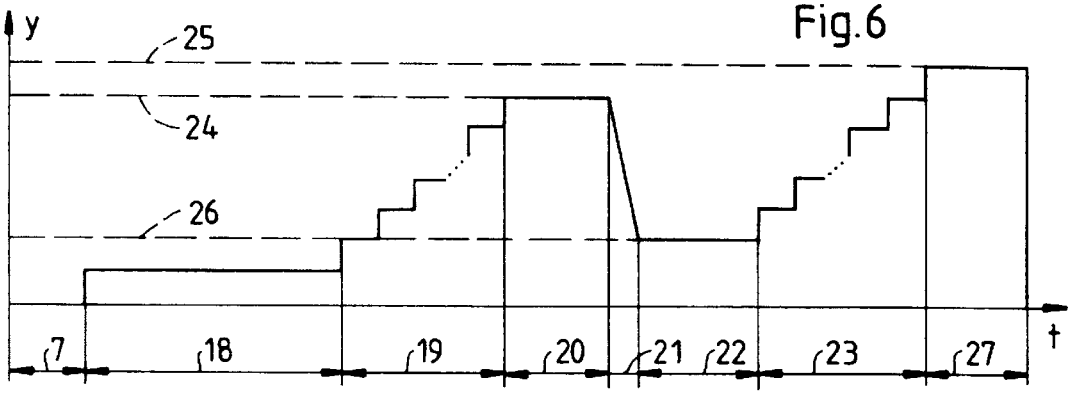
FIG. 6 is a similar view of another mode of the invention.

FIG. 6 shows the variation in current density with respect to time for a further process. After the waiting period 7 for the acclimatization of the workpiece to the galvanic bath, there follows a direct-current pulse 18, which is identical in nature to the direct current pulse 8 in FIG. 2. Thereafter, there directly follows a nucleation phase 19, in which the current density is increased step by step to the structure current density 24. The current density is then held at the structure current density during the ramp working period 20 and is subsequently lowered during phase 21 in ramp-like manner to a final value 26. After a short waiting period 22, there again follows a nucleation phase 23 with stepwise increase of the current density to the new structure current density 25, the starting current density of the nucleation phase 23 being identical to the end value 26 to which the current density was lowered at the end of the preceding structure-producing cycle. During the ramp working period 27, the current density is then held at the structure Current density 25 and, thereafter, is lowered in steps to the new end value of 0 mA/cm$^2$.

Figure 7:
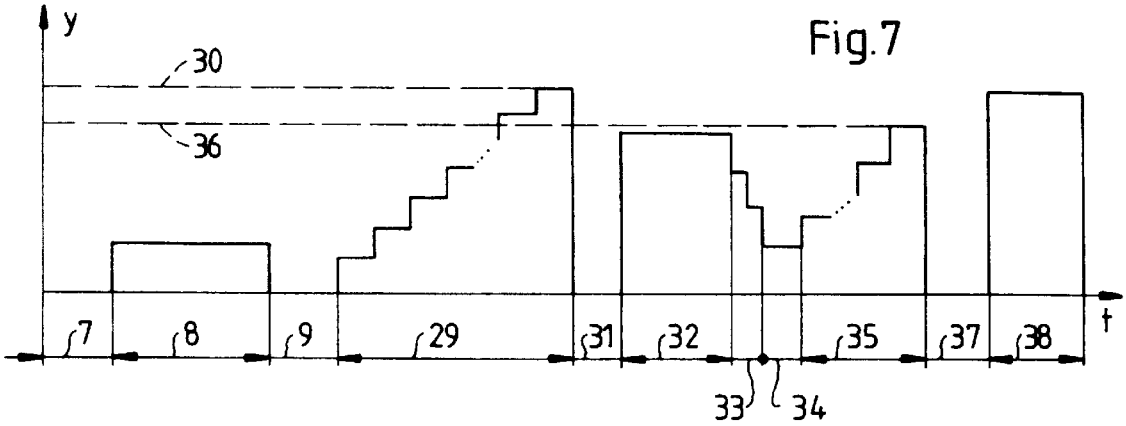
FIG. 7 is a similar view of yet another mode of the invention.

FIG. 7 shows the variation in current density with respect to time for a further variant of the process. The process stages 7 to 9 have already been discussed with reference to FIG. 2. The process current is then increased step by step to the structure current density 30 during phase 29. Thereafter, during the ramp working period 32, a process current with a current-density value of 80% of the structure current density 30 is applied. In between, there is a current-free rest period 31. After expiration of the ramp working period 32, the process current is lowered during phase 33 to an end value. The end value serves as the starting value for a second structure-producing cycle, beginning with the stepwise rise in current in phase 35. After the new structure current density 36 has been reached, a process current with a current-density value of 120% of the structure current density 36 is applied during the ramp working period 38. In between, there is once again interspersed a current-free rest period 37.

Additional information with regard to the background of this invention is found in my earlier U.S. Pat. No. 5,415,761, which is herein incorporated by reference.

I claim:

1. An improved process for electrochemically depositing a surface coating, wherein a component is subjected to a galvanic bath and the surface coating is deposited on the component with an outer surface topography, by forming a plurality of island formations of deposition material on a surface of the component by providing an electrical waveform as a source of electrical energy, and causing a growth of the deposition material on the plurality of island formations for forming the outer surface topography with a follow-up waveform as the source of electrical energy during a growth working period, the improvement which comprises:

increasing a strength of a current density of the electrical waveform during the step of forming the plurality of island formations in a plurality of steps with a waiting period between respective step increases of the plurality of steps of 0.1 to 30 seconds, the current density of the electrical waveform being changed in an amount from 1 to 6 mA/cm$^2$ per step.

2. The process according to claim 1, wherein in the step of increasing the current density of the electrical waveform, a final value of the current density is obtained which is defined as a structure current density, and subsequent to the step of increasing the current density of the electrical waveform, increasing a size of the plurality of islands by applying a process current at a current density of between 80% and 120% of the structure current density.

3. The process according to claim 2, which comprises defining the structure current density in a range from 30 mA/cm$^2$ to 180 mA/cm$^2$.

4. The process according to claim 2, which comprises defining the growth working period at between 1 and 600 sec.

5. The process according to claim 2, which comprises defining the growth working period at 30 sec.

6. The process according to claim 2, which comprises decreasing the process current to an end value after the growth working period.

7. The process according to claim 6, which comprises, in the decreasing step, lowering the process current step by step, with each decrease being between −1 and −8 mA/cm$^2$ per step.

8. The process according to claim 7, which further comprises consecutively repeating the steps of increasing the strength of the current density of the electrical waveform and of decreasing the process current to the end value such that the end value of the process current during each step of decreasing the process current corresponds to a starting value of the process current for a next one of the steps of increasing the current density.

9. The process according to claim 6, wherein the component has an electrically conductive surface, and the process further comprises cyclically repeating the afore-recited process steps between two and twenty times, and in repetition utilizing the end value of a preceding cycle as a starting value of a respectively following cycle.

10. The process according to claim 1, which comprises maintaining each of the plurality of steps for approximately 7 sec.

11. The process according to claim 1, which comprises increasing a current density in 10 to 240 steps.

12. The process according to claim 1, which further comprises, prior to the increasing step, applying a direct-current waveform with a current density of 15 to 60 mA/cm$^2$ for building a direct-current base layer on the surface of the component.

13. The process according to claim 1, wherein the component is a cylinder, and the process comprises forming a surface structure on lubricant-storage regions for holding lubricants of the cylinder.

14. The process according to claim 1, which further comprises forming a surface structure on the component for setting defined reflection factors on surfaces in optical, medical equipment and for functional and decorative applications in the furniture and sanitary industries.

15. The process according to claim 1, wherein the component is a graphics industry component, and the process further comprises forming a surface structure with a defined roughness on the component.

16. The process according to claim 1, wherein the component is a tool, and the process comprises forming a structured surface on the tool.

17. A process for electrochemically depositing a surface coating on a machine component, which comprises:

connecting a machine component in a direct current loop and defining an electric current;

immersing the component in a galvanic bath;

forming islands of deposition material on a surface of the machine component with a waveform of the electric current;

subsequently causing a growth of the deposition material on the islands with another waveform of the electric current;

during the step of forming the islands of deposition material, increasing a current density of the electric current from 1 to 6 $mA/cm^2$ in each of a plurality of steps, and pausing for 0.1 to 30 seconds between the steps.

18. The process according to claim 17, wherein the step of increasing the current density of the electric current includes increasing the current density from a starting value to a predetermined structure current density, and increasing the current density in the bath until a basic structure layer is formed on the component comprising a deposit layer of individual adjacent, approximately spherical or dendritic bodies; and subsequently, in the causing a growth step, maintaining a process current in the current loop with a current density in the range from 80% to 120% of the structure current density during a predetermined growth working period.

* * * * *